US005116103A

United States Patent [19]

Lewins et al.

[11] Patent Number: 5,116,103

[45] Date of Patent: May 26, 1992

[54] METHOD OF STEERING A MINING MACHINE

[75] Inventors: Foster Lewins, Mickleover; Bruce N. Roth, Burton-on-Trent; John S. Wykes, Chellaston, all of England

[73] Assignee: Coal Industry (Patents) Limited, United Kingdom

[21] Appl. No.: 653,630

[22] Filed: Feb. 11, 1991

[30] Foreign Application Priority Data

Feb. 9, 1990 [GB] United Kingdom ..... 9002956

[51] Int. Cl.[5] ..... E21C 35/24

[52] U.S. Cl. ..... 299/1.6

[58] Field of Search ..... 299/1, 30, 42; 364/420

[56] References Cited

U.S. PATENT DOCUMENTS 4,228,508 10/1980 Benthaus ..... 364/420
4,643,482 2/1987 Wolfender ..... 299/42 X
4,976,495 12/1990 Lewins et al. ..... 299/1

FOREIGN PATENT DOCUMENTS 2027548 2/1980 United Kingdom ..... 299/1
2092641 8/1982 United Kingdom ..... 299/1
2226348 6/1990 United Kingdom .

*Primary Examiner*—David J. Bagnell
*Attorney, Agent, or Firm*—Stevens, Davis, Miller & Mosher

[57] ABSTRACT

A method of steering a double-ended ranging drum mining machine including the steps of positioning a first current cut roof follower at or adjacent the center of the machine and measuring the machine tilt by a second sensor. The coal thickness is estimated by using a third sensor and the data gathered is used in generating algorithms therefrom whereby the height differences between points on the current cut roof can be calculated to control and steer the leading and trailing cutting drums. The algorithms are generated in such a manner that cumulative errors along or towards the face are minimized or eliminated.

12 Claims, 1 Drawing Sheet

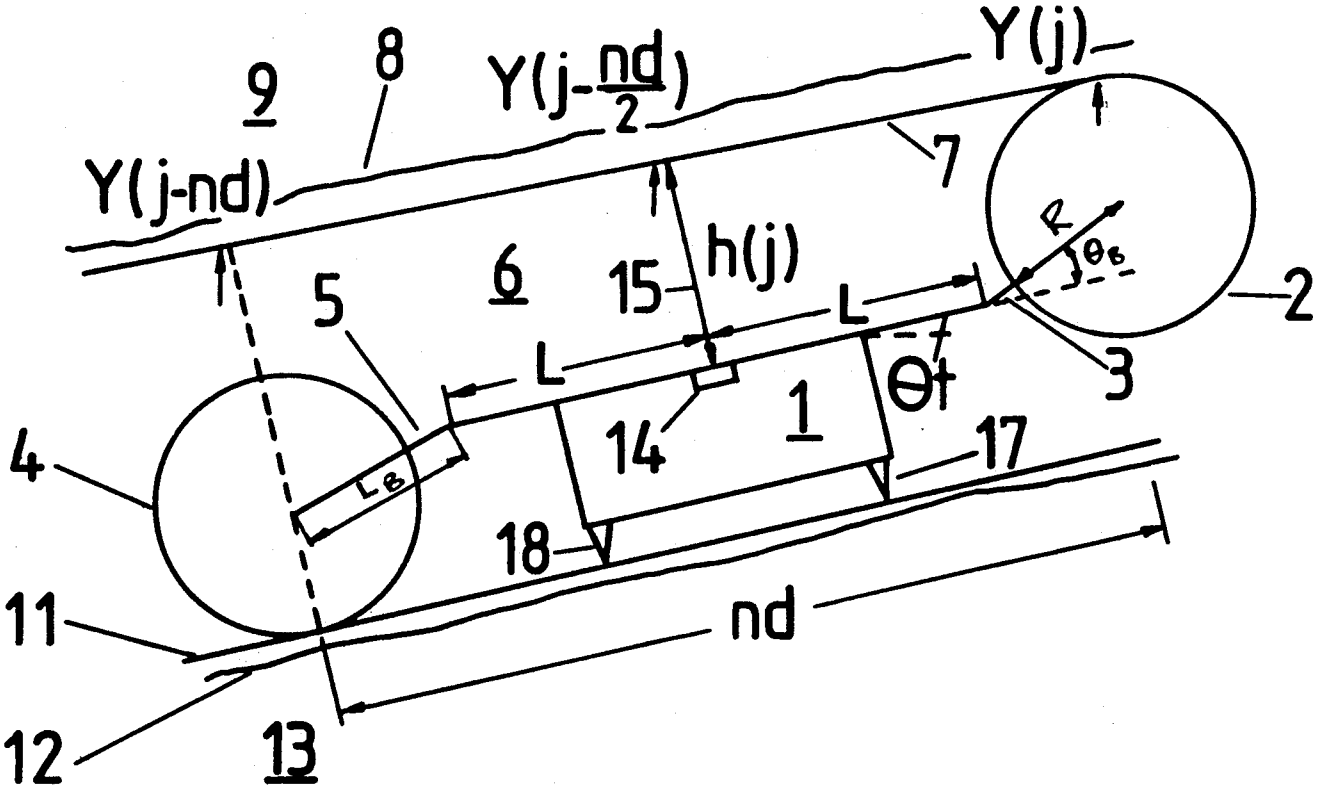
Y(j)
Y(j-nd/2)
Y(j-nd)
h(j)
L
L
nd
1
2
3
4
5
6
7
8
9
11
12
13
14
15
17
18
Le

METHOD OF STEERING A MINING MACHINE

This invention relates to a method of steering a mining machine and is particularly concerned with the steering of a double-ended ranging drum mining machine.

Such machines are used in particularly in mining minerals, such as coal, where the desired mineral is extracted from a seam by a long-wall mining method. In the long-wall mining method the machine successively traverses a face which may be of the order of 250 m in length, cutting the mineral as it goes. The machine carries a rotating cutting drum at each end of its ranging arms and one of the drums cuts, as a leading drum, the top of the seam while the other, the trailing drum, cuts the lower part of the seam.

It is necessary in order to maximize the economics of the mining operation to ensure that the fullest extraction of the desired mineral from the seam is taken, without there being any excursion by the cutting drums into the overlying or underlying strata. This is usually achieved by determining that a desired thickness of the mineral is left at the roof and the floor. Roof coal also helps in stabilizing roof conditions. A typical roof thickness is of the order of 100 mm.

One way in which this roof thickness is maintained is by measuring the amount of natural gamma radiation emitted by the adjacent strata. This radiation can be picked up by a gamma detector situated on the machine and the strength of the signal received is dependent on the attenuation of the signal by the quantity of roof left after the cutting operation. If the signal is attenuated too far as the thickness increases, then a correction steering signal can be given to alter the angle of the ranging arm to alter the cut so that a lesser thickness of roof is left.

However, in order to achieve this, it is also necessary to measure physically the roof step, i.e. the difference in roof heights between the previous pass cut roof, at which a roof coal thickness measurement is available, and the leading drum, in order that further steering of the drum can take place. Currently, this measurement is usually effected by using a roof follower attached to the ranging arm itself. This follower contacts the roof, cut on the previous pass, but adjacent to the drum, and physically follows its contours. As deviations occur, a transducer produces electrical signals which can be fed to a comparator for altering the angle of the ranging arm as necessary.

The steering may also be controlled by a factor which takes account of the inclination or tilt of the machine towards the face.

Particularly in deep seams, the roof follower, which is located in a vulnerable position close to the drum, may be a very long cantilevered arm and thus quite flexible and liable to damage, for example by mineral falling from the roof or by irregularities in the roof itself.

In assignee's copending U.K. Patent Applications Nos. 8819056.6, published Feb. 14, 1990 under No. 2,221,709A and 8829975.5, published Jun. 27, 1990 under No. 2,226,348A, we have described a method of measuring various parameters for steering respectively the leading and the trailing drum of a mineral mining machine using information taken on the previous cut. This method, which does not include vulnerably placed followers, uses a transferred reference provided by the base of the machine itself to predict the height of the cut roof above an initial reference datum. However, if conditions are right, this method may lead to cumulative errors resulting in a non-optimal positioning of the machine.

SUMMARY OF THE INVENTION

It is an object of the present invention to provide an alternative method of steering which employs a less vulnerably placed roof follower and yet which avoids cumulative positional errors along the face. Through the introduction of a strategically placed current cut roof follower, or roof height sensor, an algorithm will be developed which will reduce all steering control variables to local height differences (effectively local cut roof height differences), angles and coal thickness measurements.

According to the present invention, a method of steering a double-ended ranging drum mining machine in a seam in which the machine has a leading cutting drum arranged to cut mineral from a face to a distance at or near the interface of the mineral and an adjacent roof stratum, and a trailing cutting drum arranged to remove residual material from the face and to form a floor, characterized in that the method includes the steps of positioning a first current cut roof follower means at or adjacent the centre of the machine, measuring the machine tilt using second means, estimating coal thickness using third means and generating algorithms (as defined hereinafter) therefrom whereby the height differences between the points on the current cut roof can be calculated to control and steer the leading and trailing cutting drums, the algorithm being generated in such a manner that cumulative errors along or towards the face are minimized or eliminated.

The height differences are calculated and may be used immediately or may be stored in memory for future use.

The roof follower means may be one or more roof followers or non-contacting roof height sensors measuring the height of the machine below the current cut roof but is preferably a single follower placed at or adjacent to the centre of the machine.

The second means will include measurements for determining the tilt of the machine towards the face and the tilt of the machine along the face; these measurements may include inclinometers for measuring the tilt in each direction.

Preferably the third means for determining the thickness of the mineral left at the roof is a natural gamma sensing device and will be situated at or adjacent the centre of the machine body.

The leading drum algorithm uses height differences between follower and leading drum recorded on the previous cut to predict that required on the adjacent current cut with coal thickness measurements providing a necessary correction.

The trailing drum algorithm uses the stored current cut height difference between follower and leading drum, at such delay that they approximately coincide with the present trailing drum and follower along face positioned to provide the desired extraction.

BRIEF DESCRIPTION OF THE DRAWING

In order to assist in the understanding of the invention, the method of steering a machine in accordance with the invention will now be described with reference to the schematic accompanying single FIGURE of drawing and suitable algorithms deduced therefrom for the case of a current cut follower placed at the centre of the machine.

DETAILED DESCRIPTION OF THE INVENTION

In the drawing, the body of the machine is shown at 1 and it carries a leading cutting drum 2 at the end of a ranging boom or arm 3 and a trailing cutting drum 4 at the end of a ranging boom or arm 5.

The drum 2 is arranged to cut in a seam 6 of a desired mineral, in this case coal, to form a roof 7 having a thickness on average of typically 100 mm at its interface 8 with the overlying stratum 9.

The trailing drum 4 cuts a floor 11 to leave a thin floor spaced from an interface 12 of its underlying stratum 13.

The body of the machine 1 carries at 14 a natural gamma sensor substantially at the centre of its top surface and has a follower 15 in the form of a roof height sensor or an arm extending normally from the surface of the body 1 to the roof 7. Both the natural gamma sensor and roof follower measure the current cut roof in the wake of the leading drum.

The body 1 is supported on shoes 17 and 18 which are the leading and trailing shoes respectively.

In this example, it is assumed that the face is not horizontal but is t an angle $\theta_t$ to the horizontal. For simplicity, it is assumed that the face advance is horizontal.

There will be reference to an arbitrary datum line from which vertical distances are assumed measured. However, it will be shown that each algorithm can be made to depend on local height difference only, so avoiding any cumulative errors.

The roof at the point of the leading drum is assumed to be at a vertical position Y(j) with respect to the arbitrary datum and the position of the roof above the trailing drum is at a position Y(j−nd); the height of the roof between these two points and directly above the sensor 14 and at the point where it is contacted by the roof follower 15 is Y(j−nd)/2), and the distance between the centre points of the two drums is nd. Each drum 2 and 4 has a radius R and the ranging arms 3 and 5, of length $L_B$, are pivoted about the body at a distance L from the centre of the machine body 1 at a height H above the shoes. The ranging arm makes an angle $\theta_B$ to the top surface of the machine 1. The top surface of the machine body at its centre is at a distance h(j) from the roof at the point Y(j−nd/2). The distance nd is made up of a number of determined increments as a machine movement and direction detector (MMADD intervals) and it is assumed that these increments and the distance nd will be constant and independent of other factors such as boom angle.

The provision of the roof height sensor 15 enables the difference in vertical height between the roof being cut by the leading drum and the roof being measured by the sensor 14 to be directly determined without any use of an external reference; thus $$\begin{aligned}\delta Y(j) &= Y(j) - Y(j-nd/2)\\ &= [R - h(j)]\cos\theta_t(j) + L_b\sin[\theta_{LB}(j) + \theta_t(j)] + \\ &\quad L\sin\theta_t(j).\end{aligned} \tag{1}$$

where R is the radius of the drums 2 and 3.

The following notation convention is maintained for position: all roof parameters are labelled with their actual position in MMADD increment number but all machine positions and sensed data are given the position label of the leading drum position at that time. For the trailing drum algorithm it is also required that the difference is obtained when the leading drum was cutting the roof above the current roof height sensor position i.e.

$$\begin{aligned}\delta Y(j - nd/2) &= Y(j - nd/2) - Y(j - nd)\\ &= [R - h(j - nd/2)]\cos\theta_t(j - nd/2) + \\ &\quad L \cdot \sin\theta_t(j - nd/2) + \\ &\quad L_B\sin[\theta_{LB}(j - nd/2) + \theta_t(j - nd/2)].\end{aligned} \tag{2}$$

The desired vertical position of the trailing drum centre is the difference between the roof height at j−nd and the extraction offset, e(j−nd), $$e(j-nd) = (E-R)\cdot\cos\theta_t(j-nd). \tag{3}$$

where E is the desired seam extraction height.

This equation is valid if it is assumed that the trailing drum will be steered such as to yield the desired seam extraction E and to maintain the floor surface parallel to the roof surface.

The difference between the current height of the trailing drum centre and the current roof height being measured is $$\delta Y_{TDC}(j) = Y(j-nd/2) - Y_{TDC}(j) = h(j)\cdot\cos\theta_t(j) + L\cdot\sin\theta_t(j) + L_B\sin[\theta_{TB}(j) + \theta_t(j)]. \tag{4}$$

Thus for the desired extraction $$Y_{TDC}(j) = Y(j-nd) - e(j-nd) \tag{5}$$

and subtracting Y(j−nd/2) from both sides of equation (5) the following is obtained:

$$e(j-nd) = \delta\, Y_{TDC}(j) - \delta\, Y(j-nd/2). \tag{6}$$

Substituting equations (2) (3) and (4) into equation (6) the algorithm in term of basic measurements and machine parameters is obtained i.e.

$$\begin{aligned}L_B\sin[\theta_{TB}(j) + \theta_t(j)] &= (E - R)\cos\theta_t(j - nd) + \\ &\quad [R - h(j - nd/2)]\cos\theta_t\left(j - \frac{nd}{2}\right) + \\ &\quad L\sin\theta_t(j - nd/2) + \\ &\quad L_B\sin[\theta_{LB}(j - nd/2) + \\ &\quad \theta_t(j - nd/2)] - h(j)\cdot\cos\theta_t(j) - \\ &\quad L\sin\theta_t(j).\end{aligned} \tag{7}$$

The errors in equation (7) are in the three angular measurements, and the two roof height measurements may each be assumed independent. Typically, errors in roof height measurement might be expected to be no more than several mms, while errors in tilt might be approximately $10^{-3}$ radian.

Given the various simplifying assumptions it should only be assumed that errors will be of the order of ±10 mm for such typical parameters.

The leading drum algorithm in this method is hampered by having no direct means of estimating the roof step between the present and previous cut. Leading drum positioning can be achieved, however, by using the information on changes in the vertical height of the seam top surface (i.e. the vertical height of the upper coal/stone interface) in the previous cut and making the assumption that this change is the same in the adjacent position in the present cut.

the change in seam top height between the mid-point of the machine (where both roof height and coal thickness sensors are positioned) and the leading drum is given by $$\delta S(j)=\delta\pi Y(j)+\delta t(j) \text{ (present cut)}$$

$$\delta S'(j)=\delta Y'(j)+\delta t'(j) \text{ (present cut)} \quad (8)$$

where $$\delta T(j)=t(j)-t(j-nd/2) \quad (9)$$

This assumption amounts to equating (8) and (9). (Notes that a prime denotes a measurement from the previous cut) Positioning of the leading drum is effected to achieve a desired coal thickness $t_d(j)$ and hence a desired coal thickness difference $d_{td}(j)$ so that the boom angle is adjusted to yield the desired roof height difference $$\delta Y(j)=\delta Y'(j)+\delta t'(j)-\delta t_d(j).$$

giving the algorithm $$L_B\sin[\theta_{LB}(j)+\theta_f(j)]=t'(j)-t'(j-nd/2)+t(j-nd/2)]-t_d(j)+[h(j)-R]\cos\theta_f(j)-L\sin\theta_f(j). \quad (10)$$

The measured parameters on the right hand side of equation (10) are all subject to independent errors and, although measurements from two strips are involved, there is no build up of errors from strip to strip as the actual coal thickness and roof height differences on a strip are directly measured and used for the next strip and all use of information from the previous strip is dropped once the current strip is completed. It does, however, require some additional help on the starting strip such as the use of another method of steering to initialize previous cut estimates for the leading drum algorithm.

The leading drum algorithm is heavily dependent on coal thickness measurements. In the natural gamma system errors in coal thickness might typically be ±10 mm, which, if used with this algorithm, could lead to an overall error of about ±20 mm.

We claim:

1. A method of steering a double-ended ranging drum mining machine in a seam in which the machine has a leading cutting drum arranged to cut mineral from a face to a distance at or near the interface of the mineral and an adjacent roof stratum, and a trailing cutting drum arranged to remove residual material from the face and to form a floor, the method comprising the steps of positioning a first current cut roof follower means at or adjacent the centre of the machine, measuring the machine tilt using second means, estimating coal thickness using third means and generating algorithms therefrom whereby the height difference between points on the current cut roof can be calculated to control and steer the leading and trailing cutting drums, the algorithms being generated in such a manner that cumulative errors along or towards the face are minimized or eliminated.

2. A method according to claim 1 in which the height differences are calculated and used immediately or are stored in memory for future use.

3. A method according to claim 1 in which the roof follower means comprises at least on roof follower measuring the height of the machine below the current cut roof.

4. A method according to claim 1 in which the roof follower means comprises at least one non-contacting roof height sensor measuring the height of the machine below the current cut roof.

5. A method according to claim 1 in which the roof follower means is a single follower placed at or adjacent the centre of the machine.

6. A method according to claim 1 in which the leading drum algorithm use height difference between the follower and the leading drum recorded on the previous cut to predict that required on the adjacent current cut, with coal thickness measurements providing a necessary correction.

7. A method according to claim 1 in which the trailing drum algorithm uses the stored current cut height difference between the follower and the leading drum, at such delay that they approximately coincide with the present trailing drum and follower along the face positioned to provide the desired extraction.

8. A method according to claim 1 in which the second means is adapted to determine the tilt of the machine towards the face and along the face.

9. A method according to claim 8 in which the second means are inclinometers for measuring the tilt in each direction.

10. A method according to claim 1 in which the second means is adapted to determine the tilt of the machine towards the face.

11. A method according to claim 1 in which the second means is adapted to determine the tilt of the machine along the face.

12. A method according to claim 1 in which the third means for determining thickness of the mineral left at the roof is a natural gamma sensing device and is situated at or adjacent the centre of the machine body.

* * * * *